US006786202B2

(12) United States Patent
Abdelrahman

(10) Patent No.: US 6,786,202 B2
(45) Date of Patent: Sep. 7, 2004

(54) HYDRAULIC PUMP CIRCUIT

(75) Inventor: Ashraf B. Abdelrahman, Peoria, IL (US)

(73) Assignee: Caterpillar Inc, Peoria, IL (US)

( * ) Notice: Subject to any disclaimer, the term of this patent is extended or adjusted under 35 U.S.C. 154(b) by 20 days.

(21) Appl. No.: 10/252,878

(22) Filed: Sep. 24, 2002

(65) Prior Publication Data

US 2004/0055572 A1 Mar. 25, 2004

(51) Int. Cl.[7] ..... F02M 37/04; F04B 1/34
(52) U.S. Cl. ..... 123/446; 417/279; 417/222.1
(58) Field of Search ..... 123/446, 447, 123/457, 458, 506; 417/279, 284, 222.1; 92/12.2, 13

(56) References Cited

U.S. PATENT DOCUMENTS

| | | | | |
|---|---|---|---|---|
| 1,788,288 A | | 1/1931 | Frey | |
| 2,442,361 A | | 6/1948 | Hulman | |
| 2,931,314 A | | 4/1960 | Erikson et al. | |
| 3,948,147 A | | 4/1976 | Sauer et al. | |
| 4,712,528 A | * | 12/1987 | Schaffitz | 123/446 |
| 5,039,284 A | | 8/1991 | Talaski | |
| 5,313,924 A | | 5/1994 | Regueiro | |
| 5,454,359 A | | 10/1995 | Howell | |
| 5,460,133 A | * | 10/1995 | Perr et al. | 123/446 |
| 5,471,959 A | | 12/1995 | Sturman | |
| 5,515,829 A | * | 5/1996 | Wear et al. | 123/446 |
| 5,567,123 A | | 10/1996 | Childress et al. | |
| 6,135,093 A | | 10/2000 | Kikuchi et al. | |
| 6,192,864 B1 | | 2/2001 | Nishimura | |
| 6,623,250 B2 | * | 9/2003 | Zagranski et al. | 417/220 |

* cited by examiner

*Primary Examiner*—Thomas N. Moulis
(74) *Attorney, Agent, or Firm*—Finnegan, Henderson, Farabow, Garrett & Dunner

(57) ABSTRACT

A hydraulic pump is provided that includes a housing having a fluid inlet and a fluid outlet. A pumping element is operable to increase the pressure of fluid received through the fluid inlet and to generate a flow of pressurized fluid through the fluid outlet. A control device is operatively engaged with the pumping element to control the flow rate of the flow of pressurized fluid generated by the pumping element. A fluid passageway connects the control device with the fluid outlet. A valve is disposed in the fluid passageway between the fluid outlet and the control valve. The valve is moveable between a first position where the valve blocks a flow of fluid relative to the fluid passageway and a second position where a flow of fluid is allowed to flow through the fluid passageway.

23 Claims, 2 Drawing Sheets

HYDRAULIC PUMP CIRCUIT

TECHNICAL FIELD

The present disclosure is directed to a circuit for a hydraulic pump and, more particularly, to a drain prevention circuit for a hydraulic pump.

BACKGROUND

Hydraulic pumps are commonly used for many purposes in many different applications. Vehicles, such as, for example, highway trucks and off-highway work machines, commonly include hydraulic pumps that are driven by an engine in the vehicle to generate a flow of pressurized fluid. The pressurized fluid may be used for any of a number of purposes during the operation of the vehicle. A highway truck, for example, may use pressurized fluid to operate a fuel injection system or a braking system. A work machine, for example, may use pressurized fluid to propel the machine around a work site or to move a work implement.

A hydraulic pump typically draws fluid from a reservoir and applies work to the fluid to increase the pressure of the fluid. The hydraulic pump may direct the pressurized fluid into a fluid rail or another supply system. The hydraulic pump may be configured to vary the amount of pressurized fluid that is directed into the fluid rail. This may be accomplished with a variable displacement pump or with a fixed displacement pump that has a variable flow.

A typical hydraulic pump includes a control mechanism that governs the operation of the pump. The control mechanism may, for example, control the displacement of the pump, the flow rate of the pump, the output pressure of the pump, or the horsepower or torque input to the pump. As described in U.S. Pat. No. 5,567,123 to Childress et al., these types of control mechanisms may use pressurized fluid that is generated during the operation of the hydraulic pump as an input. This may be accomplished by returning a portion of the pressurized fluid generated by the pump to the control mechanism.

When, however, the pump is stopped, such as when the engine of the vehicle is shut off, the connection between the output of the hydraulic pump and the control mechanism can allow some fluid to escape from the fluid rail. The escaping fluid may allow for the formation of air pockets within the fluid rail. This may be a more significant problem when the hydraulic pump is mounted in a position where the pump is physically lower than the fluid rail. When the engine and hydraulic pump are re-started, the hydraulic pump will have to force the air from the fluid rail before the hydraulic system will operate as expected. In certain applications, such as, for example, in a fuel injection system, this can cause difficulty in starting the engine.

The hydraulic pump circuit of the present disclosure solves one or more of the problems set forth above.

SUMMARY OF THE INVENTION

According to one aspect, the present disclosure is directed to a hydraulic pump that includes a housing having a fluid inlet and a fluid outlet. A pumping element is operable to increase the pressure of fluid received through the fluid inlet and to generate a flow of pressurized fluid through the fluid outlet. A control device is operatively engaged with the pumping element to control the flow rate of the flow of pressurized fluid generated by the pumping element. A fluid passageway connects the control device with the fluid outlet.

A valve is disposed in the fluid passageway between the fluid outlet and the control valve. The valve is moveable between a first position where the valve blocks a flow of fluid relative to the fluid passageway and a second position where a flow of fluid is allowed to flow through the fluid passageway.

In another aspect, the present disclosure is directed to a method of operating a hydraulic pump. A pumping element is operated to increase the pressure of a fluid and generate a flow of pressurized fluid to a fluid rail. A control device is adjusted to control the flow rate of the flow of pressurized fluid to the fluid rail. A portion of the flow of pressurized fluid generated by the pumping element is directed to the control device. A valve is closed to prevent the portion of the flow of pressurized fluid from flowing to the control device when the pressure of the fluid in the fluid rail is below a predetermined limit.

DETAILED DESCRIPTION

Figure 1:
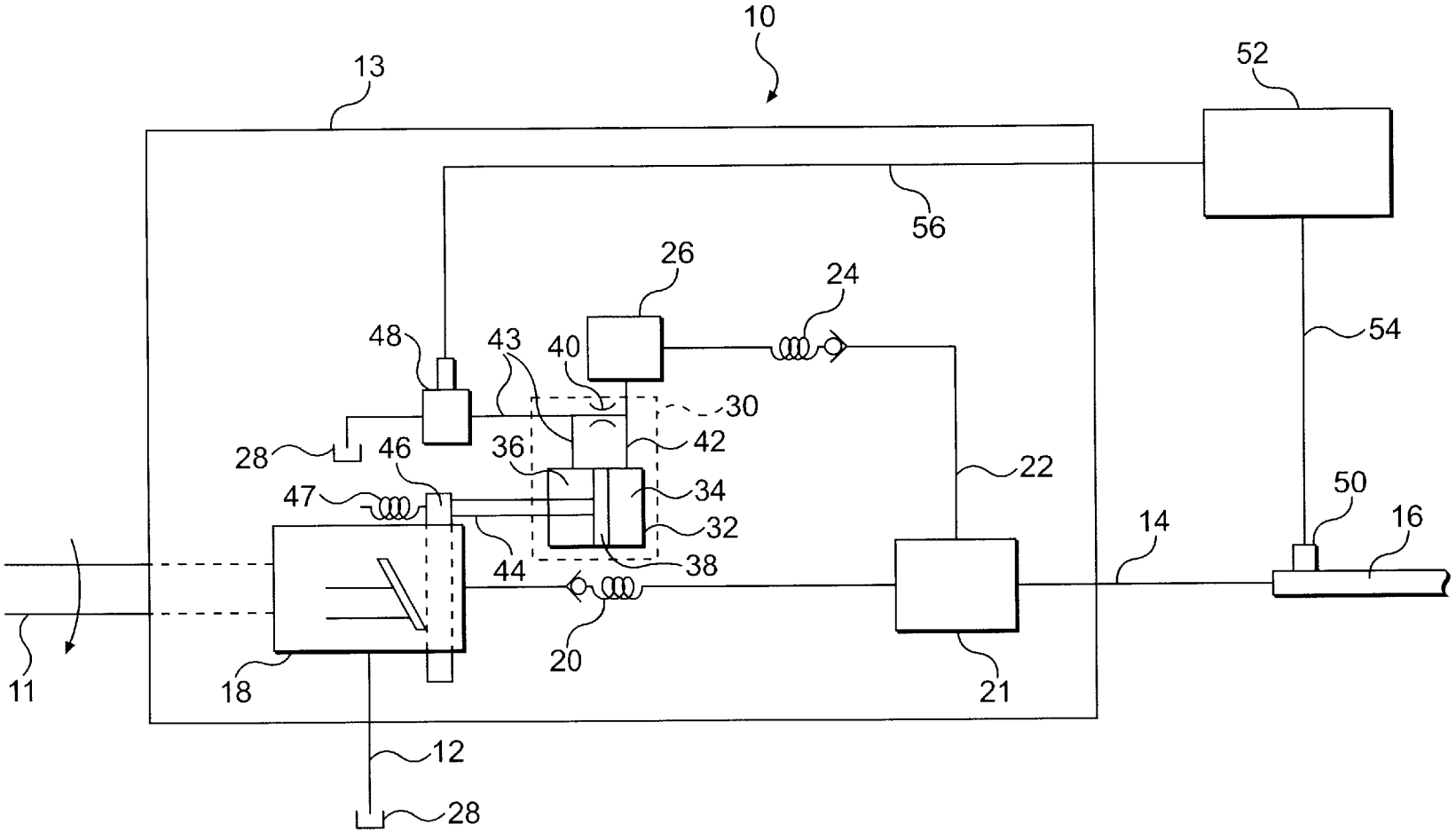
FIG. 1 is a schematic and diagrammatic representation of a first exemplary hydraulic pump.

An exemplary embodiment of a pump 10 is diagrammatically and schematically illustrated in FIG. 1. In the illustrated embodiment, pump 10 is a fixed-displacement variable flow pump. It is contemplated, however, that the present disclosure may be applied to other types of pumps, such as, for example, variable displacement pumps.

As illustrated in FIG. 1, pump 10 includes a housing 13 and an inlet 12. Inlet 12 may be connected to a tank 28 that stores a supply of low pressure operating fluid. Tank 28 may be part of an engine lubrication system, such as, for example, a lubricating oil sump and the operating fluid may be a lubricating oil.

Inlet 12 directs the low pressure operating fluid to a pumping element 18. Pumping element 18 applies work to the low pressure fluid to increase the pressure of the fluid. Pumping element 18 may include, for example, a series of pistons (not shown) that are driven by a swashplate (not shown) to pressurize the operating fluid. The angle of the swashplate may be constant to provide a fixed displacement pump. Alternatively, the angle of the swashplate may be variable to change the displacement of the pump. One skilled in the art will recognize that another type of pumping element 18 may also be used, such as, for example, a gear, gearotor, or vane pump, to pressurize the operating fluid.

Pump 10 also includes a rotating shaft 11. Rotating shaft 11 may be driven, for example, by an engine. Rotating shaft 11 may include a spline or keyed end that may be operatively engaged with the crankshaft or gear train of the engine. Rotating shaft 11 can be connected to the engine in any manner readily apparent to one skilled in the art.

Rotation of rotating shaft 11 causes pumping element 18 to draw operating fluid from tank 28 and increase the pressure of the operating fluid. A check valve 20 may be disposed between pumping element 18 and an outlet 14. Check valve 20 may be configured to open when exposed to a fluid having a pressure that exceeds a predetermined limit.

When pumping element pressurizes the operating fluid to the predetermined pressure, check valve 20 will open and allow the pressurized fluid to flow to a pump collector 21, which may store a supply of pressurized fluid. Pump collector 21 is connected to an outlet 14, which may be further connected to a fluid rail 16.

As also shown in FIG. 1, pump 10 may include a control device 30. In the illustrated exemplary embodiment, control device 30 governs the flow rate of pump 10 by controlling the position of a metering device 46. One skilled in the art will recognize, however that control device 30 may perform any controlling function that is common in a hydraulic pump, such as, for example, displacement control, flow rate control, output pressure control, torque or horsepower control, or load control.

The position of metering device 46 may control the flow rate of pressurized fluid produced by pumping element 18. Metering device 46 may be, for example, a metering sleeve that is moveable between a first position and a second position. Movement of metering device 46 from the first position to the second position may act to decrease the flow rate of pressurized fluid generated by pumping element 18. A resilient member, such as spring 47, may be engaged with metering device 46 to move metering device 46 to the first position.

As shown in FIG. 1, control device 30 is fluidly connected to pumping element 18 and to fluid rail 16. A fluid line 22 may direct a flow of pressurized fluid from pump collector 21 towards control device 30. Alternatively, fluid line 22 may be connected with the pump outlet line at any point between pumping element 18 and fluid rail 16.

A valve, such as check valve 24, may be disposed in fluid line 22. In the illustrated exemplary embodiment, check valve 24 is spring loaded and configured to open when the pressure within fluid line 22 is above a predetermined limit. For example, check valve 24 may be configured to open when the pressure within fluid line 22 is at or above about 70 kPa (10.2 psi). It should be understood that other types of valves, such as, for example, solenoid operated control valves, may be used in place of check valve 24.

As also illustrated in FIG. 1, a pressure reducing valve 26 may be disposed in fluid line 22. Pressure reducing valve 26 may be any such valve readily apparent to one skilled in the art as capable of reducing the pressure of the fluid within fluid line 22 to a certain level. Pressure reducing valve 26 may prevent damage to control device 30 by controlling the pressure of the fluid that is supplied to control device 30. For example, pressure reducing valve 26 may reduce the pressure of the fluid in line 22 to about 6 MPa (870 psi).

Control device 30 may include a piston 38 that is connected to metering device 46 through a shaft 44. Piston 38 is disposed in a cylinder 32 to define a high pressure chamber 34 and a control pressure chamber 36. Movement of piston 38 within cylinder 32 results in a corresponding movement of metering device 46.

A fluid line 42 directs reduced pressure fluid from pressure reducing valve 26 into high pressure chamber 34. A fluid line 43 directs reduced pressure fluid from reducing valve 26 into control pressure chamber 36. Fluid line 43 also directs reduced pressure fluid from reducing valve 26 through a control valve 48 to tank 28.

A restricted orifice 40 may be disposed in fluid line 43. Restricted orifice 43 reduces the flow rate of fluid through fluid line 43. When, as described in greater detail below, control valve 48 is opened, a pressure drop will develop over restricted orifice 43. This allows the fluid in fluid line 42 and in high pressure chamber 34 to maintain a higher pressure than the fluid in fluid line 43 and in control pressure chamber 36 when control valve 48 is opened.

Control valve 48 may be selectively opened to allow fluid to flow through fluid line 43 to tank 28. By opening control valve 48, the pressure of the fluid within control pressure chamber 36 may be reduced. When the pressure within control pressure chamber 36 is reduced, a pressure differential is created over piston 38 between high pressure chamber 34 and control pressure chamber 36. The pressure differential results in a force that acts through piston 38 on metering device 46. When this force overcomes the force of spring 47, metering device 46 will move towards the second position, thereby decreasing the flow rate of pressurized fluid produced by pumping element 18.

When control valve 48 is closed, the pressure of the fluid within control pressure chamber 36 will increase to be substantially equivalent to the pressure of the fluid within high pressure chamber 34. The force of spring 47 will then act to move piston 38 and return metering device 46 to the first position, thereby increasing the flow rate of fluid produced by pumping element 18. Thus, by controlling the position of control valve 48, the flow rate of pressurized fluid produced by pump 10 may be controlled.

As shown in FIG. 1, a control 52 is provided to control the position of control valve 48. Control 52 may include an electronic control module that has a microprocessor and a memory. As is known to those skilled in the art, the memory may be connected to the microprocessor and may store an instruction set and variables. Associated with the microprocessor and part of electronic control module are various other known circuits such as, for example, power supply circuitry, signal conditioning circuitry, and solenoid driver circuitry, among others.

Figure 2:
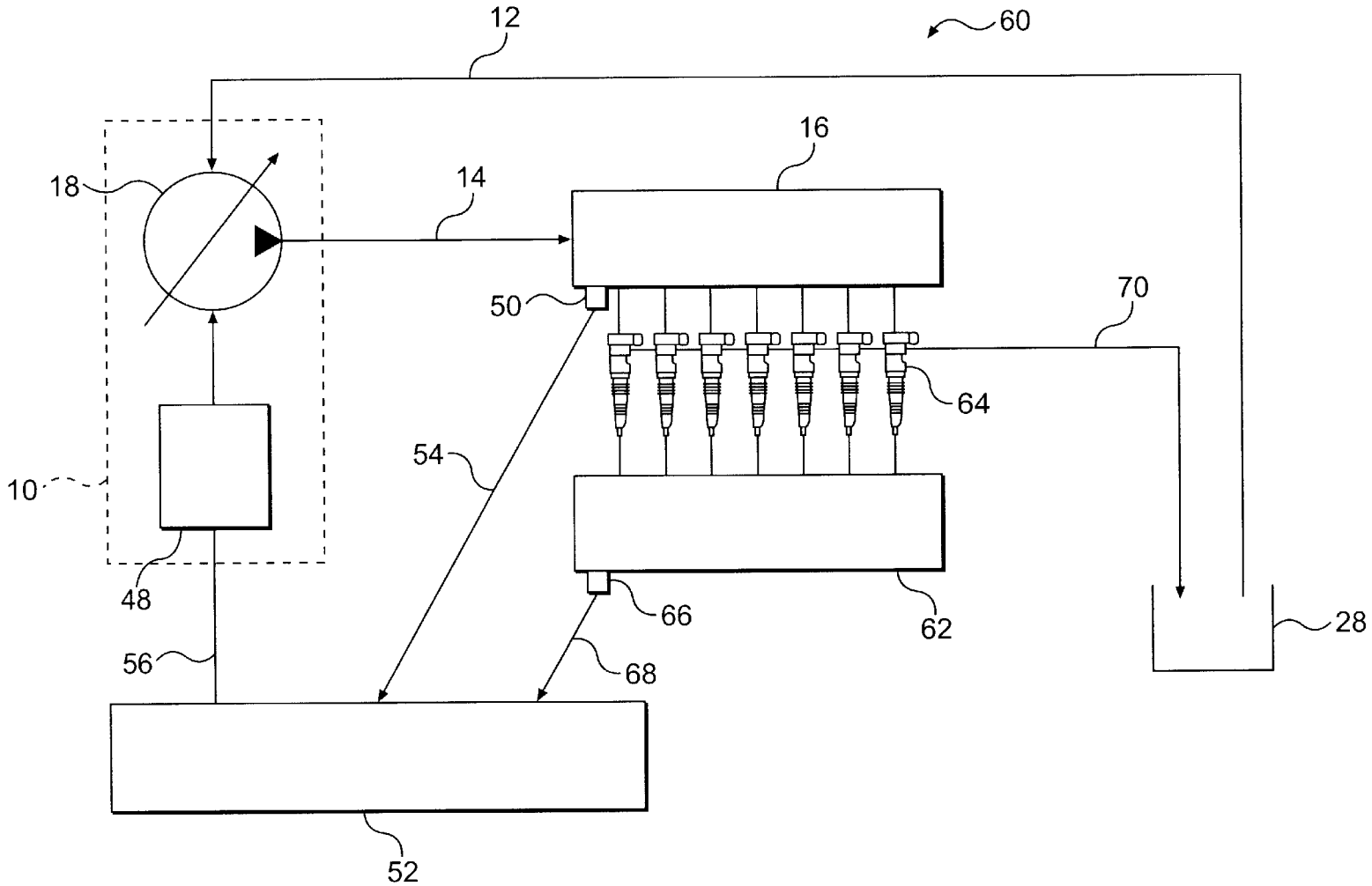
FIG. 2 is a schematic and diagrammatic representation of a fuel injection system having a hydraulic pump in accordance with an exemplary embodiment of the present invention.

As illustrated in FIG. 2, pump 10 may be included in a fuel injection system 60. One skilled in the art will recognized that pump 10 may be included in any other type of system that utilizes pressurized hydraulic fluid to operate.

As shown in FIG. 2, fuel injection system 60 includes a series of fuel injectors 64. Fuel injectors 64 may be hydraulically actuated to supply fuel to an engine 62. Fuel injectors 64 use pressurized fluid to pressurize fuel to an injection pressure. In the described embodiment, pump 10 delivers pressurized fluid through outlet 14 to fluid rail 16. Fluid rail 16 is connected to each fuel injector 64. Fuel injectors 64 draw pressurized fluid from fluid rail 16 during operation of engine 62. Fluid used by fuel injectors 64 may flow through a drain line 70 to tank 28.

Control 52 may be programmed to control one or more aspects of the operation of engine 62. For example, control 52 may connected to control valve 48 through control line 56. Control 52 may be programmed to control the position of control valve 48, the operation of the fuel injection system, and any other engine function commonly controlled by an electronic control module. Control 52 may control the operation of engine 62 based on sensed operating parameters of the engine.

As shown in FIG. 2, sensors 50 and 66 may be operatively engaged with fuel injection system 60 and/or engine 62. Sensors 50 and 66 may be connected to control 52 through, for example, control lines 54 and 68, respectively. Sensors 50 and 66 may sense one or more operating parameters of engine 62. For example, sensor 50 may be configured to sense the pressure of fluid within fluid rail 16. Sensor 66 may be configured to sense operational parameters of engine 62, such as, for example, the engine speed and/or load. One skilled in the art will recognize that various other sensors may be used to sense other operational parameters.

INDUSTRIAL APPLICABILITY

The operation of the described hydraulic pump circuit will now be described with reference to the figures. When engine 62 is operating, engine 62 will drive rotating shaft 11. The operation of rotating shaft 11 will cause pumping element 18 to generate a flow of pressurized fluid. The pressurized fluid opens check valve 20 and the pressurized fluid flows to pump collector 21.

The pressurized fluid in pump collector 21 is directed to fluid rail 16. The pressurized fluid in fluid rail 16 may be used in the operation of a system in a vehicle. For example, the pressurized fluid in fluid rail 16 may be used to operate the fuel injection system 60 illustrated in FIG. 2.

A portion of the pressurized fluid in pump collector 21 may also be directed to check valve 24. If the pressure of the fluid in pump collector 21 is above a predetermined limit, check valve 24 will open. The predetermined limit may be set to ensure that check valve 24 will open when pump 10 is operating. This may be accomplished by ensuring that the predetermined limit is less than the pressure of fluid produced during the normal operation of pump 10. For example, if pump 10 normally generates fluid having a pressure of about 30 MPa (4.4 kpsi), check valve 24 may be configured to open at a lower pressure.

When check valve 24 opens, pressurized fluid flows to pressure reducing valve 26, which decreases the pressure of the fluid flow. The reduced pressure fluid flows to control device 30. In the illustrated embodiment, control device 30 uses the pressurized fluid to move metering device 46 to adjust the rate at which pump 10 generates pressurized fluid.

Control 52 governs the position of control valve 48 to control the movement of metering device 46. To reduce the rate at which pressurized fluid is generated, control 52 opens control valve 48. This decreases the pressure of the fluid in control pressure chamber 36, which allows piston 38 to move relative to cylinder 32. Movement of piston 38 results in a corresponding movement of metering device 46, which results in a reduction in the generation of pressurized fluid.

Control 52 may increase the rate at which pressurized fluid is generated by closing control valve 48. This allows the fluid pressures in high pressure chamber 34 and control pressure chamber 36 to equalize. Spring 47 then acts to move metering device 46 to increase the generation of pressurized fluid.

When an operator stops the operation of engine 62, pump 10 will also stop producing pressurized fluid. When pump 10 is stopped, fluid rail 16 will still contain pressurized fluid. This pressurized fluid will tend to flow towards an area of lower pressure, such as, for example, towards control device 30. However, when the pressure of the fluid in fluid rail 16 subsides below the predetermined limit, check valve 24 will close to prevent fluid from leaking from the hydraulic circuit through control device 30 to tank 28.

By preventing fluid from escaping through control device 30, the hydraulic circuit will prevent air pockets from developing in fluid rail 16 when engine 62 is not operating. If air pockets form within fluid rail 16, or any other portion of the hydraulic circuit, the initial operation of pump 10 will be used to purge these air pockets from the system. Thus, the proper operation of the hydraulic system driven by pump 10 may be delayed or impaired.

Any delay in the proper operation of fuel injection system 60 may cause difficulty in starting engine 62. Engine 62 will not start and run smoothly until fuel injectors 64 are provided with a steady supply of pressurized fluid. By preventing the formation of air pockets, the described hydraulic circuit may ensure that fuel injectors 64 receive the required supply of pressurized fluid to start the engine and quickly achieve steady-state operation.

In addition, a pump 10 with check valve 24 may be installed at a lower elevation than fluid rail 16. Check valve 24 will prevent fluid from draining from fluid rail 16 when pump 10 is not operating. Accordingly, pump 10 may be installed at any elevation relative to fluid rail 16. This may provide increased flexibility when designing an engine to fit within a particular engine compartment.

It will be apparent to those skilled in the art that various modifications and variations can be made in the described hydraulic pump circuit without departing from the scope of the invention. Other embodiments may be apparent to those skilled in the art from consideration of the specification and practice of the hydraulic pump circuit disclosed herein. It is intended that the specification and examples be considered as exemplary only, with a true scope of the present disclosure being indicated by the following claims and their equivalents.

What is claimed is:

1. A hydraulic pump, comprising:

a housing having a fluid inlet and a fluid outlet;

a pumping element operable to increase the pressure of fluid received through the fluid inlet and to generate a flow of pressurized fluid through the fluid outlet;

a control device operatively engaged with the pumping element to control the flow rate of the flow of pressurized fluid generated by the pumping element;

a low pressure reservoir;

a drain passageway fluidly connecting the control device with the low pressure reservoir;

a control valve disposed in the drain passageway between the control device and the low pressure reservoir, the control valve being configured to selectively allow fluid to flow from the control device to the low pressure reservoir to reduce a pressure within the control device;

a fluid passageway connecting the control valve with the fluid outlet; and a valve disposed in the fluid passageway between the fluid outlet and the control valve, the valve moveable between a first position where the valve blocks a flow of fluid relative to the fluid passageway and a second position where a flow of fluid is allowed to flow through the fluid passageway.

2. The pump of claim 1, further including a pressure reducing valve disposed in the fluid passageway between the valve and the control device.

3. The pump of claim 2, wherein the pressure reducing valve reduces the pressure of fluid flowing from said valve to the control device to approximately 6 Mpa.

4. The pump of claim 1, wherein the valve is a check valve configured to move from the first position to the second position when the pressure of the fluid in the fluid passageway is greater than about 70 Kpa.

5. The pump of claim 1, wherein the pumping element increases the pressure of the fluid to between about 6 Mpa and 30 Mpa.

6. The pump of claim 1, wherein the pumping element is a piston slidably disposed in a bore.

7. The pump of claim 1, wherein the valve is contained within the housing.

8. The pump of claim 1, wherein the control device includes a metering device and a piston slidably disposed in a cylinder and connected to the metering device, wherein movement of the metering device from a first position to a second position decreases the flow rate of the flow of pressurized fluid generated by the pumping element.

9. The pump of claim 8, wherein the cylinder defines a first chamber and a second chamber disposed on opposite sides of the piston, each of the first and second chambers being in fluid connection with the fluid passageway and wherein the control valve is operable to control the pressure of the fluid in the second chamber.

10. The pump of claim 9, further including a restricted orifice disposed between the fluid passageway and the first chamber and a spring acting on the metering device to move the metering device towards the first position.

11. A method of operating a hydraulic pump, comprising:

operating a pumping element to increase the pressure of a fluid and generate a flow of pressurized fluid to a fluid rail;

adjusting a control valve to selectively communicate a low pressure reservoir with a control device, thereby causing the control device to control the flow rate of the flow of pressurized fluid to the fluid rail;

directing a portion of the flow of pressurized fluid generated by the pumping element to the control valve; and closing a valve to prevent the portion of the flow of pressurized fluid from flowing to the control valve when the pressure of the fluid in the fluid rail is below a predetermined limit.

12. The method of claim 11, further including opening the valve when the pressure of the fluid in the fluid rail is above the predetermined limit.

13. The method of claim 12, wherein the predetermined limit is about 70 Kpa.

14. A fuel injection system, comprising:

a tank configured to hold a supply of fluid;

a fluid rail;

a fuel injector in fluid connection with the fluid rail; and a hydraulic pump, including a housing having a fluid inlet in fluid communication with the tank and a fluid outlet in fluid communication with the fluid rail;

a pumping element operable to increase the pressure of fluid received through the fluid inlet and to generate a flow of pressurized fluid through the fluid outlet;

a control device operatively engaged with the pumping element to control the flow rate of the flow of pressurized fluid generated by the pumping element;

a drain passageway fluidly connecting the control device with the tank;

a control valve disposed in the drain passageway between the control device and the tank, the control valve being configured to selectively allow fluid to flow from the control device to the tank to reduce a pressure within the control device;

a fluid passageway connecting the control valve with the fluid outlet; and a valve disposed in the fluid passageway between the fluid outlet and the control valve, the valve moveable between a first position where the valve blocks a flow of fluid relative to the fluid passageway and a second position where a flow of fluid is allowed to flow through the fluid passageway.

15. The system of claim 14, further including a pressure reducing valve disposed in the fluid passageway between the valve and the control device.

16. The system of claim 14, wherein the valve is a check valve configured to move from the first position to the second position when the pressure of the fluid in the fluid passageway is greater than about 70 Kpa.

17. The system of claim 14, wherein the pumping element is a piston slidably disposed in a bore.

18. The system of claim 14, wherein the control device includes a metering device and a piston slidably disposed in a cylinder and connected to the metering device, wherein movement of the metering device from a first position to a second position decreases the flow rate of the flow of pressurized fluid generated by the pumping element.

19. The system of claim 18, wherein the cylinder defines a first chamber and a second chamber disposed on opposite sides of the piston, each of the first and second chambers being in fluid connection with the fluid passageway and wherein the control valve is operable to control the pressure of the fluid in the second chamber.

20. The system of claim 19, further including a restricted orifice disposed between the fluid passageway and the first chamber and a spring acting on the metering device to bias the metering device towards the first position.

21. The pump of claim 1, wherein the valve is disposed between the outlet and the control device.

22. The method of claim 11, wherein the step of closing a valve also prevents the portion of flow of pressurized fluid from flowing to the control device when the pressure of the fluid in the fluid rail is below a predetermined limit.

23. The system of claim 14, wherein the valve is disposed between the outlet and the control device.

* * * * *